US008132617B2

(12) United States Patent
Magnus

(10) Patent No.: US 8,132,617 B2
(45) Date of Patent: Mar. 13, 2012

(54) GRIPPER BLOCK

(76) Inventor: David Brian Magnus, Calgary (CA)

( * ) Notice: Subject to any disclaimer, the term of this patent is extended or adjusted under 35 U.S.C. 154(b) by 226 days.

(21) Appl. No.: 12/605,712

(22) Filed: Oct. 26, 2009

(65) Prior Publication Data

US 2010/0132935 A1 Jun. 3, 2010

Related U.S. Application Data

(60) Provisional application No. 61/108,593, filed on Oct. 27, 2008.

(51) Int. Cl.
*E21B 19/08* (2006.01)

(52) U.S. Cl. ..... 166/77.3; 226/172

(58) Field of Classification Search ..... 166/77.1, 166/77.2, 77.3; 226/172, 173
See application file for complete search history.

(56) References Cited

U.S. PATENT DOCUMENTS

| | | | | |
|---|---|---|---|---|
| 3,559,905 | A | 2/1971 | Palynchuk | |
| 5,975,203 | A | 11/1999 | Paynee et al. | |
| 6,173,769 | B1 | 1/2001 | Goode | |
| 6,189,609 | B1 | 2/2001 | Shaaban et al. | |
| 6,332,501 | B1 | 12/2001 | Gipson | |
| 6,609,566 | B2 | 8/2003 | Perio, Jr. | |
| 2001/0040031 | A1 * | 11/2001 | Shaaban et al. | 166/77.3 |
| 2002/0189819 | A1 * | 12/2002 | Neal | 166/384 |

* cited by examiner

*Primary Examiner* — William P Neuder
(74) *Attorney, Agent, or Firm* — Ryan W. Dupuis; Kyle R. Satterthwaite; Ade & Company Inc.

(57) ABSTRACT

A gripper block for conveying continuous rod in a well bore comprises a carrier body formed of a first metal and arranged to be mounted on one of the pair of continuous drive chains of a continuous rod conveying apparatus. A gripping element supported on the carrier body is arranged to engage the continuous rod and is readily separable from the carrier body. The gripping element is formed of a second metal which is softer than the first metal of the carrier body and softer than the continuous rod.

19 Claims, 5 Drawing Sheets

GRIPPER BLOCK

This application claims the benefit under 35 U.S.C. 119(e) of U.S. provisional application Ser. No. 61/108,593, filed Oct. 27, 2008.

FIELD OF THE INVENTION

The present invention relates to a gripper block for use with drive chains of a conveying apparatus for conveying continuous sucker rod relative to a well bore through a path defined between elongate parallel runs of the drive chains.

BACKGROUND

In using a continuous sucker rod string in a well, it is known to use an injector to inject into or pull the rod from the well. U.S. Pat. No. 3,559,905 by Palynchuk discloses a method and apparatus for running and pulling a continuous metal member into and out of a well. The apparatus uses a pair of opposed driven endless tracks provided with gripping pads to grip the continuous metal member between the pads and pull it out of the well. The gripping pads comprise an elastomeric element having poor wear resistance and providing a poor grip on the member when the member is dirty.

Other types of injectors used for the different application of conveying coiled tubing are described in U.S. Pat. No. 6,609,566 by Perio Jr., U.S. Pat. No. 6,332,501 by Gipson, U.S. Pat. No. 5,975,203 by Payne et al., and U.S. Pat. No. 6,189,609 by Shaaban et al. and U.S. Pat. No. 6,173,769 by Goode. Typically gripping pads are formed of elastomeric material, polymers or graphite composites to prevent damage to the tubing. In general these types of gripping elements have poor wear resistance and must be replaced frequently at great cost. The poor wear resistance is unsuitable for use with a metal sucker rod. In some instances the gripping members comprise steel or tungsten carbide, however the hardness of these metals would cause considerable damage and wear to the metal finish of a typical sucker rod.

In some instances the gripper members comprise integral blocks mounted onto the drive chains so that replacement of the blocks requires separation of the block by disassembly of the chain at considerable expense of time and cost. In other instances the gripper members include replaceable elements, however the manner of supporting the replaceable elements typically provides minimal structure for adequately transferring drive forces from the drive chains to the rod string being conveyed.

SUMMARY OF THE INVENTION

According to one aspect of the invention there is provided a gripper block arranged for use with a conveying apparatus arranged for conveying continuous rod in a well bore in which the conveying apparatus comprises a pair of continuous drive chains supported on the frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain, the carrier body being formed of a first metal; and a gripping element supported on the carrier body so as to be arranged to engage the continuous rod and so as to be arranged to be readily separated from and reattached to the carrier body, the gripping element being formed of a second metal which is softer than the first metal and which is arranged to be softer than the continuous rod.

Preferably the carrier body is formed of steel and the gripping element is formed of aluminum.

According to a second aspect of the present invention there is provided a gripper block arranged for use with a conveying apparatus arranged for conveying continuous rod in a well bore in which the conveying apparatus comprises a pair of continuous drive chains supported on the frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain; and a gripping element supported on the carrier body so as to be arranged to engage the continuous rod and so as to be arranged to be readily separated from and reattached to the carrier body;

the gripping element comprising a main portion including a recess extending in a longitudinal direction across an upper face of the main portion so as to be arranged to receive a portion of the continuous rod therein and a protrusion extending downwardly from the main portion opposite the recess;

the carrier body comprising a socket arranged to receive the protrusion of the gripping element therein, the socket comprising two side walls extending in the longitudinal direction of the recess along opposing sides of the socket and two end walls extending between the two side walls at opposing ends of the socket such that the protrusion is received between the two side walls and between the two end walls in the socket.

According to a further aspect of the present invention there is provided a gripper block arranged for use with a conveying apparatus arranged for conveying continuous rod in a well bore in which the conveying apparatus comprises a pair of continuous drive chains supported on the frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain;

a gripping element supported on the carrier body so as to be arranged to engage the continuous rod and so as to be arranged to be readily separated from and reattached to the carrier body;

the gripping element comprising:

a main portion including a recess extending in a longitudinal direction across an upper face of the main portion so as to be arranged to receive a portion of the continuous rod therein; and a protrusion extending downwardly from the main portion opposite the recess;

the main portion including two end portions extending in the longitudinal direction beyond the protrusion at opposing ends of the main portion;

the carrier body comprising a socket arranged to receive the protrusion of the gripping element therein, the socket and the protrusion having a mating rectangular cross section and the socket comprising:

two side walls extending in the longitudinal direction of the recess along opposing sides of the socket; and two end walls extending between the two side walls at opposing ends of the socket;

the side walls of the socket extending upwardly beyond a flat top side of the end walls;

the protrusion of the gripping element being received between the two side walls and between the two end walls in the socket such that a flat bottom side of the end portions of the main portion overlap and engage the flat top sides of the end walls of the socket respectively and such that the side walls of the socket extend along two opposing sides of the main portion of the gripping element in the longitudinal direction of the recess; and a retaining pin member extending between the side walls of the socket fully through the protrusion of the gripping element below the main portion of the gripping element such that the retaining pin member is arranged to be received across a full width of the carrier body in a lateral direction oriented perpendicularly to the longitudinal direction of the recess.

By providing a replaceable gripping element which is formed of softer metal than the carrier body fastened to the drive chains, a gripping element is provided having considerably better wear performance than some of the softer materials commonly user on coiled tubing so as to be more suitable for metal sucker rod while remaining soft enough to prevent damage to the sucker rod. By also providing a carrier body of stronger metal than the gripping element, the advantages of even further wear resistance of the stronger metal can still be achieved in the carrier body to minimize the cost and time consumed for changing the gripping elements as compared to integral blocks without concern for damaging the sucker rods due to the softer replaceable gripping element. Furthermore the improved socket design of the present invention provides greater support to the gripping element to transfer drive forces from the drive chains to the rod being conveyed while the retaining pin member is fully isolated from these transfer forces by fully surrounding the gripping element with the carrier body configuration.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
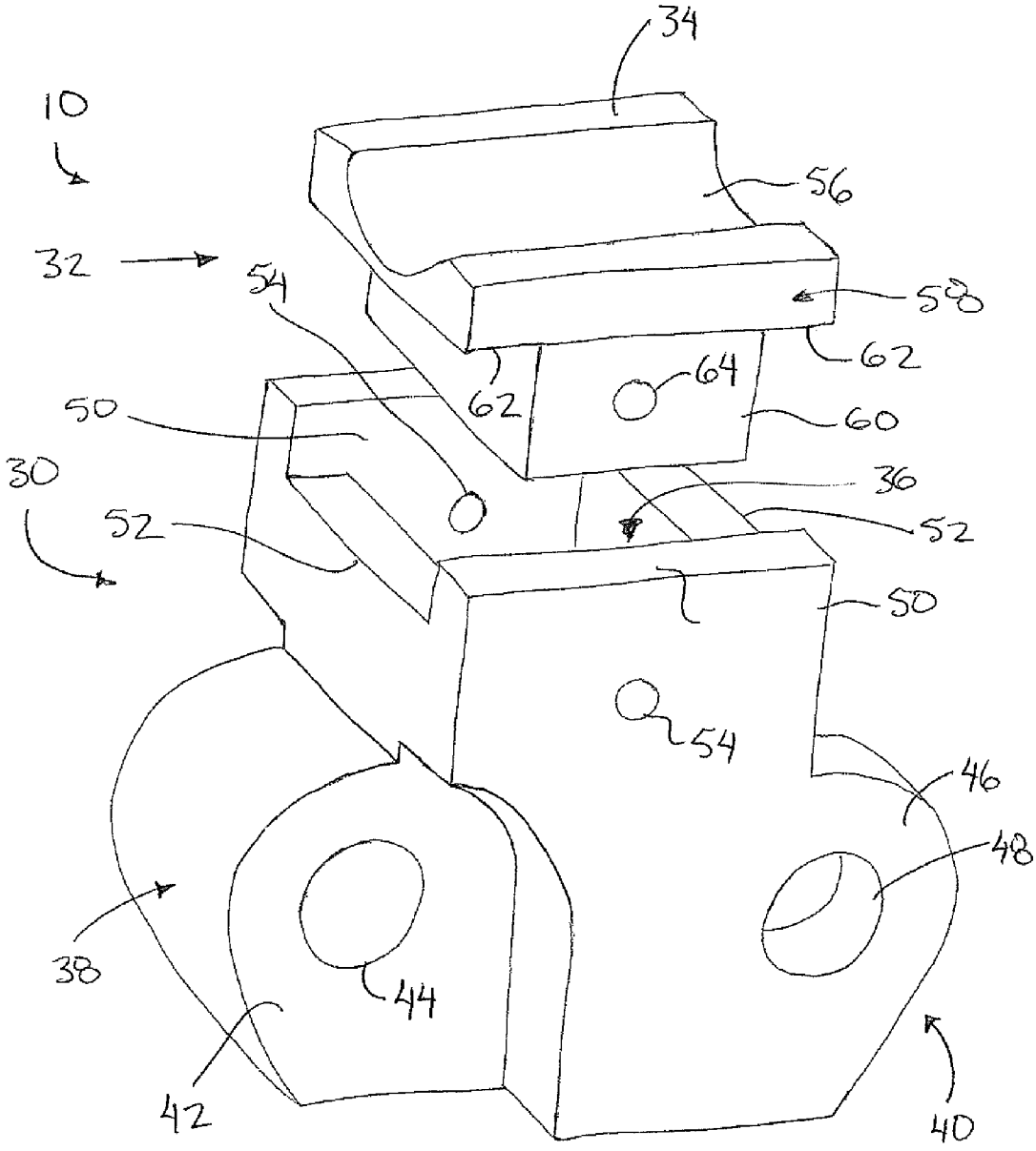
FIG. 1 is an exploded perspective view of the gripper block.
Figure 6:
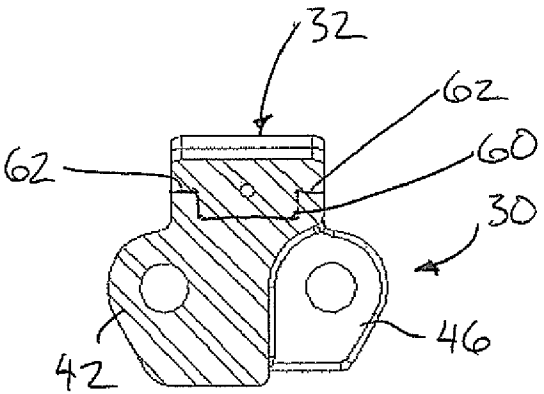
FIG. 6 is a sectional view along the line 6-6 of FIG. 3.
Figure 4:
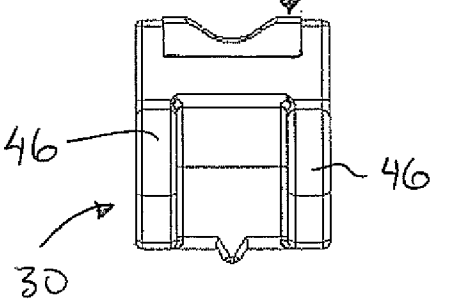
FIG. 4 is an end elevational view of the gripper block.
Figure 3:
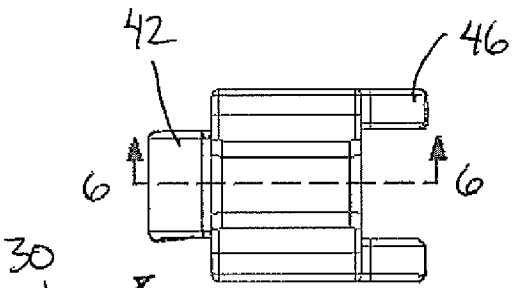
FIG. 3 is a top plan view of the gripper block.
Figure 2:
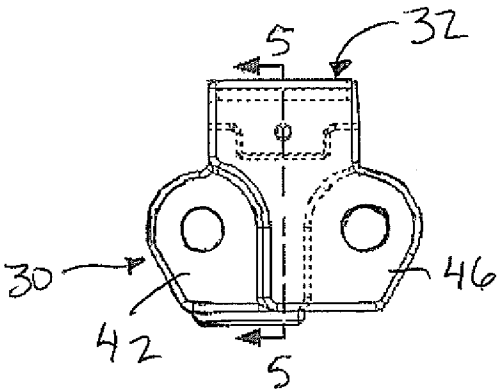
FIG. 2 is a side elevational view of the gripper block.
Figure 5:
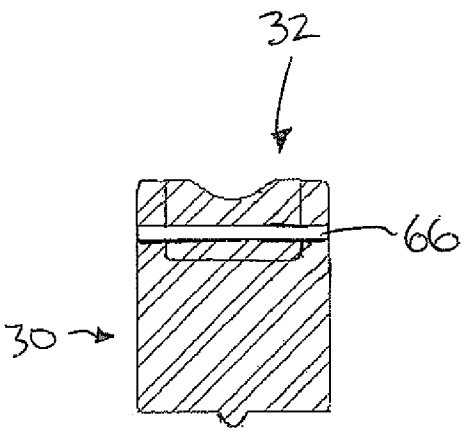
FIG. 5 is a sectional view along the line 5-5 of FIG. 2.
Figure 11:
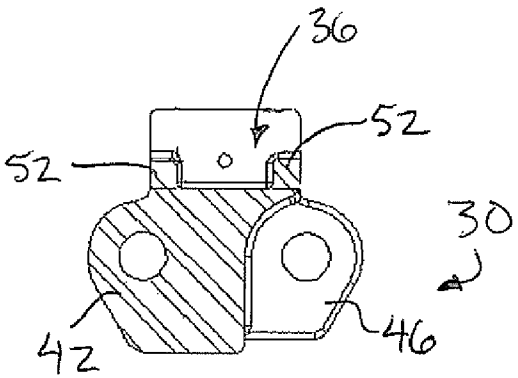
FIG. 11 is a sectional view along the line 11-11 of FIG. 8.
Figure 9:
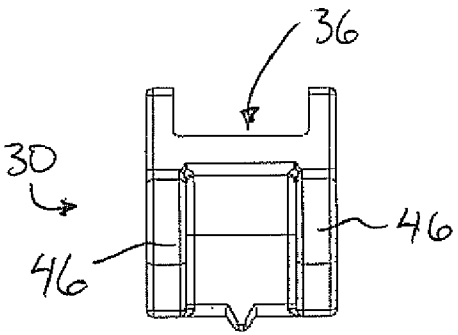
FIG. 9 is an end elevational view of the carrier body.
Figure 8:
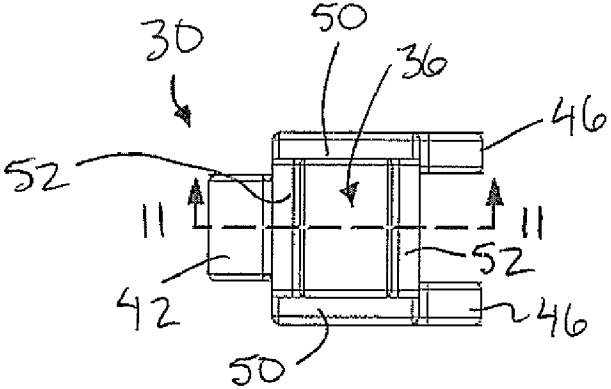
FIG. 8 a top plan view of the carrier body.
Figure 7:
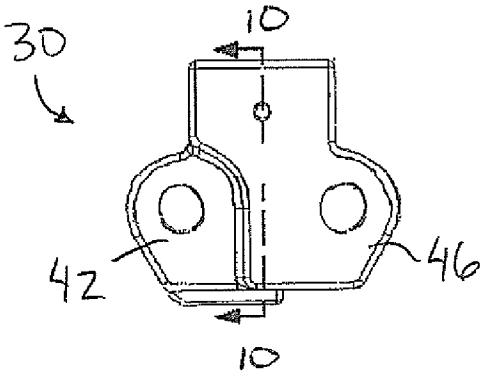
FIG. 7 is a side elevational view of the carrier body with the gripping element shown removed.
Figure 10:
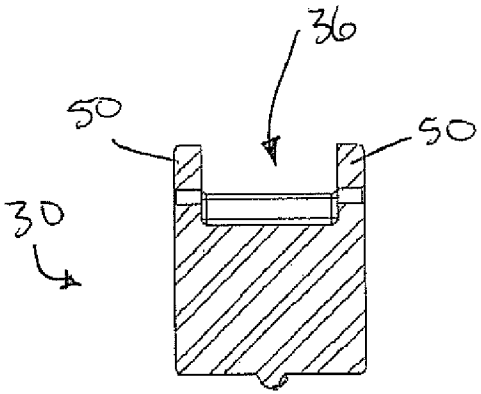
FIG. 10 is a sectional view along the line 10-10 of FIG. 7.
Figure 13:
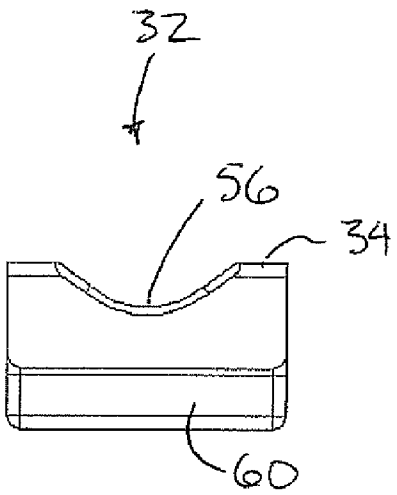
FIG. 13 is an end elevational view of the gripping element.
Figure 12:
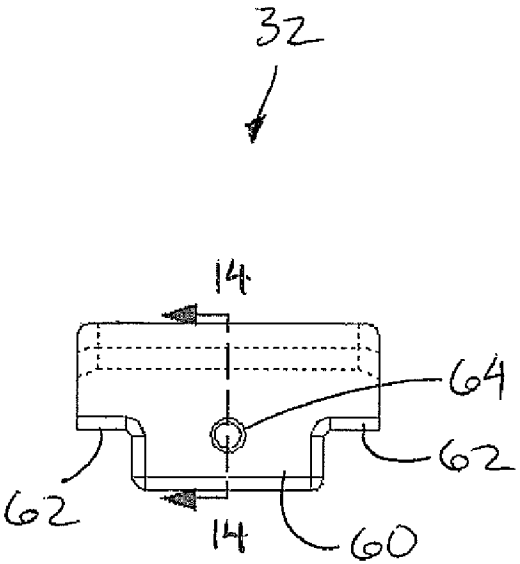
FIG. 12 is a side elevational view of the gripping element shown separated from the carrier body.
Figure 14:
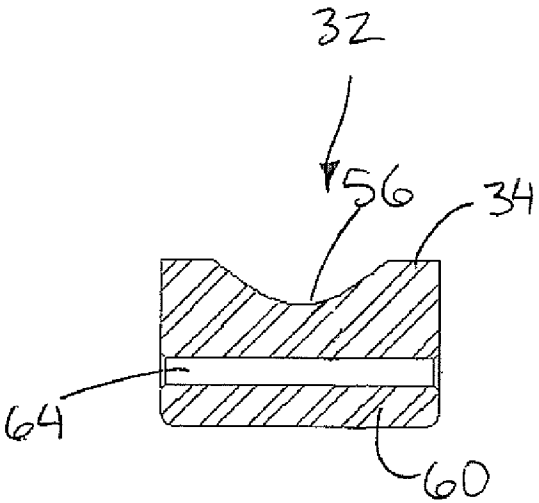
FIG. 14 is a sectional view along the line 14-14 of FIG. 12.

Referring to the accompanying figures there is illustrated a gripper block generally indicated by reference numeral 10. The block 10 is particularly suited for use on a conveying apparatus such as an injector 12 used with an accelerator rig for pulling continuous sucker rod stings 14 out of the casing of the well or for injecting or conveying the rod into the well.

Figure 15:
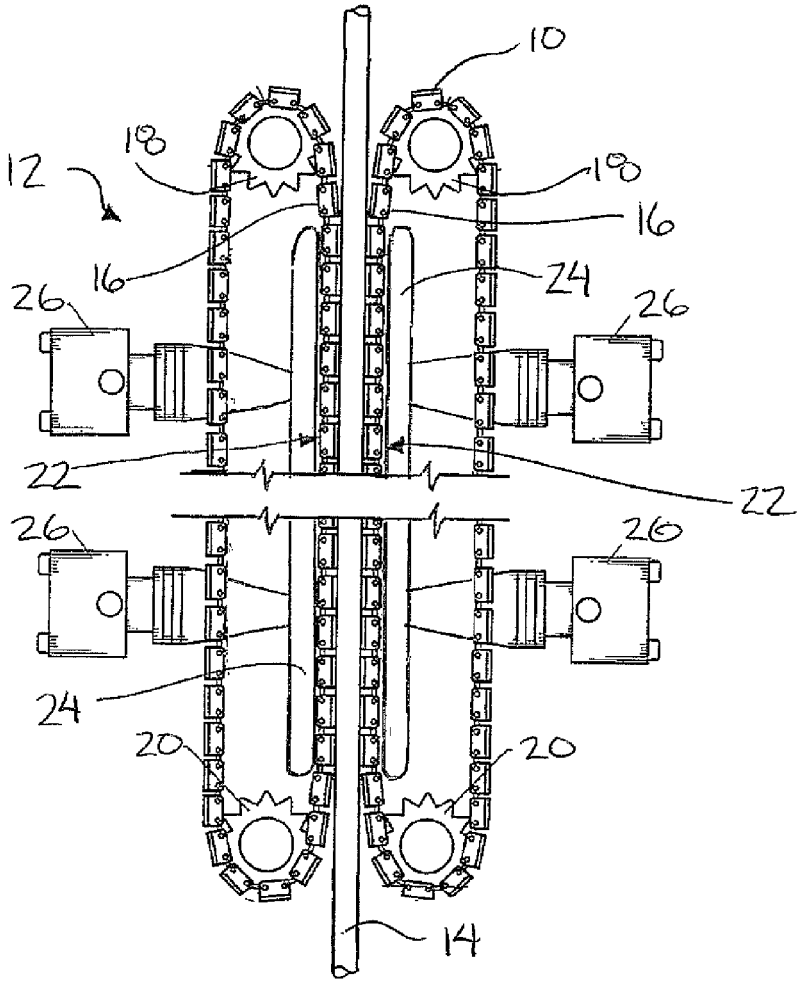
FIG. 15 is a schematic elevational view of the conveying apparatus for conveying continuous rod.

As shown in FIG. 15, the injector 12 comprises a frame supporting two continuous endless drive chains 16 thereon for rotation within a generally common upright plane. Each of the chains is supported for rotation about an upper sprocket 18 and a lower sprocket 20 in which one of the sprockets is driven to rotate by a hydraulic motor (not shown) and the other sprocket comprises an idler sprocket arranged to take up the slack in the chain. Each of the drive chains 16 is arranged to rotate along an inner vertical run 22 such that the two vertical runs of the two chains run parallel and spaced apart so as to be opposed from one another with a suitable space defined therebetween forming a longitudinal path arranged to receive the continuous sucker rod 14 for displacement with the chains in the longitudinal direction of the rod and the vertical runs 22

A plurality of the gripper blocks 10 of identical configuration are coupled to one another and to the links of the chain to form a combined chain assembly in which the gripper blocks rotate with the chain about the sprockets so that the gripper blocks confront one another along the vertical runs of the drive chains for gripping opposing sides of the continuous sucker rod 14 received therebetween.

In order to apply a gripping pressure to clamp or grip the rod between the opposed vertical runs of the drive chains supporting the gripper blocks thereon, each of the vertical runs of the drive chains are provided with skates 24 which apply pressure to the chains on the rear interior side thereof opposite the gripping blocks such that when the opposed skates 24 of the two drive chains are urged towards one another the gripper blocks on opposing sides of the rod are tightened against one another. A surface of the skates 24 which engage the drive chains can include rollers or lower friction material thereon to reduce friction of the drive chains sliding along the skates in the longitudinal direction. Suitable hydraulic rams 26 can be used to apply pressure to the skates for producing the clamping force on opposing sides of the continuous rod 14. By increasing the hydraulic pressure, an increased clamping pressure is applied to the opposed gripper blocks.

Now referring more generally to FIG. 1 through 14, each gripper block 10 comprises a carrier body 30 arranged to attach to the drive chains 16. Each carrier body 30 supports a gripping element 32 thereon having an upper surface 34 arranged to engage and grip the continuous sucker rod 14. The gripping element 32 is supported on the carrier body 30 as to remain readily separable and so as to be readily reattached to the carrier body as may be desired.

The carrier body 30 includes a top side locating a socket 36 therein which receives a portion of the gripping element 32 therein in a mounted configuration. The carrier body further comprises a bottom side arranged for interconnecting a plurality of carrier bodies in series with one another for relative articulation with the relative articulation between adjacent links of the drive chains. The carrier body extends generally in a longitudinal direction of the chain between a first end 38 and a second end 40 arranged to be pivotally coupled to the first end of another gripper block of similar configuration. More particularly the first end 38 comprises a tongue 42 which is generally centered in the lateral direction and which extends longitudinally outward for connection to an adjacent gripper block. The tongue 42 includes a laterally extending pin hole 44 centrally therein which extends fully through the tongue in a direction which is perpendicular to the longitudinal direction.

The second end 40 of the bottom side of the carrier body includes laterally spaced apart ears 46 which each include a suitable pin hole 48 therein extending in a lateral direction through the ears in alignment with one another. The ears 46 are suitably spaced to receive the tongue of an adjacent gripper block therebetween such that the pin hole 44 aligns with the pin holes 48 in the ears to receive a coupling pin therethrough. Typically the coupling pin comprises a continuous pin which also serves to mount adjacent links of adjacent runs of chain alongside the interconnected plurality of gripper blocks to form an endless chain assembly including a central row of gripper blocks bound by two rows of linked chain elements along opposing sides of the central row of gripper blocks.

The socket 36 located in the upper portion of the carrier body of each gripper block is square in cross section so as to be surrounded by two side walls 50 extending along two opposing sides of the socket in the longitudinal direction and two end walls 52 spanning in a lateral direction between the two side walls at longitudinally opposed ends of the socket. The two side walls and the two end walls all extend vertically upward from the bottom portion of the carrier body to respective flat top edges. The two side walls extend vertically upward beyond the top edge of both end walls.

A single retainer aperture 54 is located in each of the two side walls 50 so that the two retainer apertures extend though the carrier body in the lateral direction aligned with one another in height and in the longitudinal direction at a height which is below a height of the end walls 52.

The gripping elements 32 of each gripper block is arranged so that the upper surface 34 thereof includes a suitable recess 56 formed therein which extends in the longitudinal direction fully across the gripping element to be open at the opposed ends thereof. The recess 36 is generally semi-circular in cross section so as to have concave profile when viewed from either end. The gripping element 32 includes a main portion 58 which extends in the longitudinal direction, between the ends of the gripping element, a length which corresponds to the full length of the upper surface 34 and which corresponds to the length of the side walls 50 of the socket in the longitudinal direction. The gripping element further comprises a protrusion 60 extending downwardly from the main portion at a central position in the longitudinal direction. The protrusion 60 is square having the same cross sectional dimensions as the socket 36 for mating configuration therewith. The protrusion extends downwardly opposite the recess 56 in the upper surface so as to be arranged for vertical sliding insertion downwardly into the socket 36 when mounting the gripping element onto the carrier body.

The protrusion 60 spans laterally the full width of the main portion 58 so as to span the full width of the socket between the side walls 50 thereof. The protrusion 60 also has a length in a longitudinal direction which fits between the two end walls 52 of the socket but which is shorter than the main portion 50 in the longitudinal direction such that the main portion extends longitudinally outward beyond the protrusion at both ends thereof to define two end portions 62 of the main portion.

Each of the two end portions has a flat bottom which is arranged to overlap and engage the flat top end of the end walls of the socket. The end portions 62 have a length in the longitudinal direction corresponding to the thickness of the end walls so that the opposed ends of the main portion are flush with the exterior side of the end walls respectively.

The thickness of the main portion 58 above the protrusion 60 corresponds to the height of the side walls extending upwardly beyond the height of the end walls so that the main portion 58 is flush along opposing sides at the top side thereof with the two side walls 50 arranged to extend longitudinally along opposing sides of the main portion of the gripping element when the gripping element is mounted onto the carrier body.

A retainer aperture 64 extends in a lateral direction fully through the gripping element in alignment with the protrusion 60 below the main portion 58 of the gripping element so as to be suitably arranged for alignment with the retainer apertures 54 in opposed side walls of the socket. Accordingly when the protrusion 60 is inserted into the socket 36, a retaining pin member 66 can be fully inserted in the lateral direction through the carrier body and the gripping element received therein such that the retaining pin member 66 spans laterally a full width of the carrier body as a single integral pin member.

The carrier body 30 is formed of steel or other similar metal as the drive chains for increased wear resistance over the life of the drive chains. The gripping element 32 is instead formed of a softer metal, comprising aluminum in the preferred embodiment. The aluminum gripping element is thus softer than the chrome finish on the continuous sucker rod 14 being engaged to prevent damage to the rod. The aluminum gripping element is also sufficiently rigid to provide adequate gripping force to the rod while exhibiting considerably greater wear resistance than common materials for gripping elements used on coiled tubing in the prior art for example.

Figure 16:
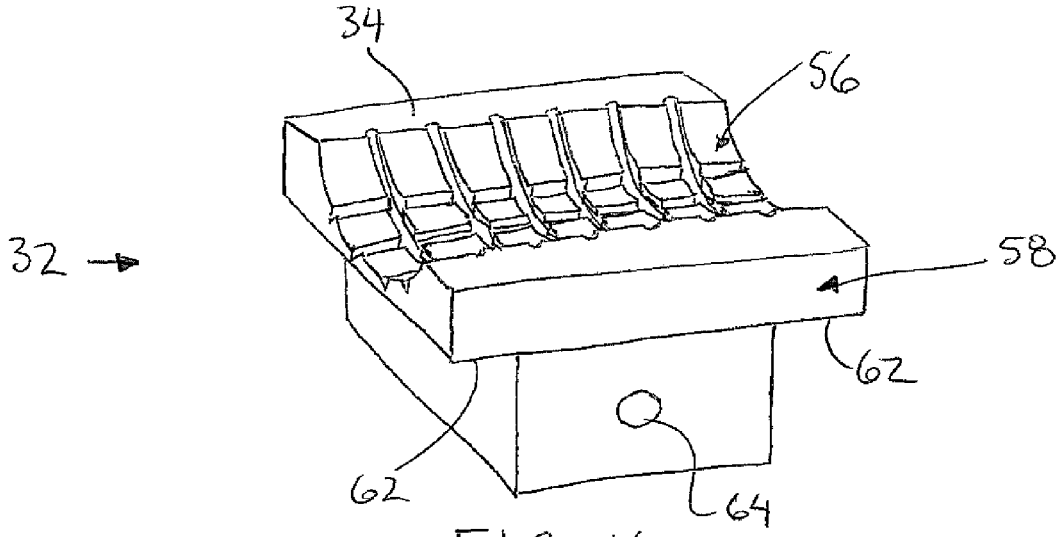
FIG. 16 is a perspective view of an alternative embodiment of the gripping element.

Turning now to FIG. 16, a further embodiment of the gripping element is illustrated in which the configuration of the main portion and the protrusion are substantially identical to the embodiment of FIG. 1 for mounting to the carrier body in a similar configuration. Instead of a relatively smooth concave surface forming the recess 56 in the upper face as shown in FIG. 1 however, in the embodiment of FIG. 16, a plurality of longitudinally and laterally extending grooves 70 are formed in the concave surface of the recess 56 to provide an improved gripping surface of greater friction for gripping the continuous sucker rod with greater gripping force. The serrated configuration of the recess 56 as shown in FIG. 16 provides increased gripping force but without concern for damaging the rod due to the softer aluminum material forming the gripping element which is less likely to mark or damage the continuous sucker rod 14.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A gripper block arranged for use with a conveying apparatus arranged for conveying continuous rod in a well bore in which the conveying apparatus comprises a pair of continuous drive chains supported on a frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain, the carrier body being formed of a first metal; and a gripping element supported on the carrier body so as to be arranged to engage the continuous rod and so as to be arranged to be readily separated from and reattached to the carrier body, the gripping element being formed of a second metal which is softer than the first metal and which is arranged to be softer than the continuous rod;

wherein the gripping element comprises a main portion including a recess extending in a longitudinal direction across a working face of the main portion so as to be arranged to receive a portion of the continuous rod therein and a protrusion extending from the main portion opposite the recess in the working face; and wherein the carrier body comprises a socket arranged to receive the protrusion of the gripping element therein, the socket comprising two side walls extending in the longitudinal direction of the recess along opposing sides of the socket and two end walls extending between the two side walls at opposing ends of the socket such that the protrusion is received between the two side walls and between the two end walls in the socket.

2. The gripper block according to claim 1 wherein the gripping element is formed of aluminum.

3. The gripper block according to claim 1 wherein the carrier body is formed of steel.

4. The gripper block according to claim 1 in combination with a continuous sucker rod.

5. The gripper block according to claim 1 in combination with a continuous sucker rod comprising a chrome finish.

6. The gripper block according to claim 1 wherein the main portion of the gripping element comprises two end portions extending in the longitudinal direction beyond the protrusion at opposing ends of the main portion.

7. The gripper block according to claim 6 wherein the end portions of the main portion overlap the end walls of the socket.

8. The gripper block according to claim 6 wherein the end portions have a flat bottom side arranged to be engaged upon a flat top side of the end walls respectively.

9. The gripper block according to claim 1 wherein the side walls of the socket extend upwardly beyond a top side of the end walls along two opposing sides of the main portion of the gripping element.

10. The gripper block according to claim 1 wherein the socket and the protrusion have a mating rectangular cross section.

11. The gripper block according to claim 1 wherein there is provided a retaining pin member extending between the side walls of the socket fully through the gripping element.

12. The gripper block according to claim 11 wherein the retaining pin member extends through the protrusion of the gripping element below the main portion.

13. The gripper block according to claim 1 wherein there is provided a retaining pin member received through cooperating apertures in the carrier body and the gripping element so as to be arranged to be received across a full width of the carrier body in a lateral direction oriented perpendicularly to the longitudinal direction of the recess.

14. A gripper block arranged for use with a conveying apparatus arranged for conveying continuous rod in a well bore in which the conveying apparatus comprises a pair of continuous drive chains supported on a frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain; and a gripping element supported on the carrier body so as to be arranged to engage the continuous rod and so as to be arranged to be readily separated from and reattached to the carrier body;

the gripping element comprising a main portion including a recess extending in a longitudinal direction across a working face of the main portion so as to be arranged to receive a portion of the continuous rod therein and a protrusion extending from the main portion opposite the recess in the working face;

the carrier body comprising a socket arranged to receive the protrusion of the gripping element therein, the socket comprising two side walls extending in the longitudinal direction of the recess along opposing sides of the socket and two end walls extending between the two side walls at opposing ends of the socket such that the protrusion is received between the two side walls and between the two end walls in the socket.

15. The gripper block according to claim 14 wherein the main portion of the gripping element comprises two end portions extending in the longitudinal direction beyond the protrusion at opposing ends of the main portion.

16. The gripper block according to claim 15 wherein the end portions of the main portion overlap the end walls of the socket.

17. The gripper block according to claim 15 wherein the end portions have a flat bottom side arranged to be engaged upon a flat top side of the end walls respectively.

18. The gripper block according to claim 14 wherein the side walls of the socket extend upwardly beyond a top side of the end walls along two opposing sides of the main portion of the gripping element.

19. A gripper block arranged for use with a conveying apparatus arranged for conveying continuous rod in a well bore in which the conveying apparatus comprises a pair of continuous drive chains supported on the a frame to be rotatable within a generally common plane and such that the drive chains comprise opposed, elongate parallel runs spaced apart to form a path arranged to engage the continuous rod passing therebetween, the gripper block comprising:

a carrier body arranged to be mounted onto the chain;

a gripping element supported on the carrier body so as to be arranged to engage the continuous rod and so as to be arranged to be readily separated from and reattached to the carrier body;

the gripping element comprising:

a main portion including a recess extending in a longitudinal direction across a working face of the main portion so as to be arranged to receive a portion of the continuous rod therein; and a protrusion extending from the main portion opposite the recess in the working face;

the main portion including two end portions extending in the longitudinal direction beyond the protrusion at opposing ends of the main portion;

the carrier body comprising a socket arranged to receive the protrusion of the gripping element therein, the socket and the protrusion having a mating rectangular cross section and the socket comprising:

two side walls extending in the longitudinal direction of the recess along opposing sides of the socket; and two end walls extending between the two side walls at opposing ends of the socket;

the side walls of the socket extending upwardly beyond a flat top side of the end walls;

the protrusion of the gripping element being received between the two side walls and between the two end walls in the socket such that a flat bottom side of the end portions of the main portion overlap and engage the flat top sides of the end walls of the socket respectively and such that the side walls of the socket extend along two opposing sides of the main portion of the gripping element in the longitudinal direction of the recess; and a retaining pin member extending between the side walls of the socket fully through the protrusion of the gripping element below the main portion of the gripping element such that the retaining pin member is arranged to be received across a full width of the carrier body in a lateral direction oriented perpendicularly to the longitudinal direction of the recess.

* * * * *